US011244551B2

(12) United States Patent
Escofet Via

(10) Patent No.: US 11,244,551 B2
(45) Date of Patent: Feb. 8, 2022

(54) POINT DETECTOR FOR FIRE ALARM SYSTEM

(71) Applicant: Carrier Corporation, Palm Beach Gardens, FL (US)

(72) Inventor: Jordi Escofet Via, Barcelona (ES)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/132,295

(22) Filed: Dec. 23, 2020

(65) Prior Publication Data

US 2021/0192913 A1 Jun. 24, 2021

(30) Foreign Application Priority Data

Dec. 23, 2019 (EP) ..... 19383182

(51) Int. Cl.
*G08B 17/117* (2006.01)
*G08B 17/06* (2006.01)

(52) U.S. Cl.
CPC ..... *G08B 17/117* (2013.01); *G08B 17/06* (2013.01)

(58) Field of Classification Search
CPC ..... G08B 17/117; G08B 17/06; G08B 17/10; G08B 17/113; G08B 17/107
See application file for complete search history.

(56) References Cited

U.S. PATENT DOCUMENTS 4,254,414 A 3/1981 Street et al.
5,598,147 A * 1/1997 Mochizuki ..... G08B 17/107 250/573
5,896,082 A 4/1999 MacFarlane
6,262,668 B1 * 7/2001 Mulvihill ..... G08B 17/10 340/570
6,703,241 B1 * 3/2004 Sunshine ..... G01N 33/0006 436/147
7,196,631 B1 * 3/2007 Dziekan ..... G08B 17/10 250/380
7,504,958 B1 3/2009 Genovese et al.
7,669,457 B2 * 3/2010 Griffith ..... G08B 17/113 73/31.01
8,035,527 B2 * 10/2011 Powell ..... G08B 17/06 340/628
8,224,621 B2 * 7/2012 Ajay ..... G08B 17/10 702/176

(Continued)

FOREIGN PATENT DOCUMENTS

CN 101872527 A 10/2010
CN 104200605 A 12/2014

(Continued)

OTHER PUBLICATIONS

European Search Report for Application No. 19383182.3; dated Jul. 2, 2020; 8 Pages.

*Primary Examiner* — Hoi C Lau
(74) *Attorney, Agent, or Firm* — Cantor Colburn LLP

(57) ABSTRACT

A point detector (1) for a fire alarm system. The point detector (1) includes a fan (2) configured to aspirate air from a surrounding environment; and an inlet (3) in flow communication with the fan (2); the inlet (3) is configured to split the incoming flow into multiple streams (4); and each stream (4) of the multiple streams (4) is configured to be in flow communication with a respective sensing device (6).

13 Claims, 1 Drawing Sheet

(56) References Cited

U.S. PATENT DOCUMENTS 8,813,540 B2 * 8/2014 Dantler ..... G01N 1/14 73/28.01
8,892,399 B2 * 11/2014 Ajay ..... G08B 17/10 702/176
9,098,989 B2 8/2015 Fischer
9,208,671 B2 * 12/2015 Susel ..... G01N 1/26
9,576,458 B2 * 2/2017 Calvert ..... G08B 17/10
9,625,432 B2 * 4/2017 Villarreal Guerra ..... G01N 33/0031
9,702,802 B2 * 7/2017 Ajay ..... G08B 17/10
9,746,363 B2 * 8/2017 Ajay ..... G01N 1/2205
10,161,837 B2 * 12/2018 Ajay ..... G08B 17/113
10,345,213 B2 * 7/2019 Cooper ..... G01N 15/0227
10,495,618 B2 * 12/2019 Williamson ..... G01N 33/0031
10,558,226 B1 * 2/2020 Bigdeli ..... G05D 1/101
10,677,705 B2 * 6/2020 Cooper ..... G01N 15/0227
10,970,985 B2 * 4/2021 Antar ..... G10L 15/08
2004/0149127 A1 * 8/2004 Lyons ..... B01D 53/22 95/45
2005/0035868 A1 * 2/2005 Back ..... G08B 17/10 340/627
2006/0103521 A1 * 5/2006 Wisniewski ..... G08B 21/16 340/521
2006/0293789 A1 * 12/2006 Frazier ..... G08B 21/12 700/245
2007/0084286 A1 * 4/2007 Ajay ..... G01N 1/26 73/597
2008/0136589 A1 * 6/2008 Baird ..... G08B 15/001 340/5.64
2009/0025453 A1 * 1/2009 Griffith ..... G08B 17/113 73/31.02
2009/0058669 A1 * 3/2009 Santos ..... G08B 5/36 340/632
2009/0212959 A1 * 8/2009 Suber, III ..... G08B 25/08 340/603
2010/0039274 A1 * 2/2010 Cole ..... G01N 21/53 340/630
2010/0271219 A1 * 10/2010 Lang ..... G08B 17/10 340/628
2010/0328082 A1 * 12/2010 Danz ..... G08B 17/10 340/589
2011/0187543 A1 * 8/2011 Russo ..... G08B 17/10 340/628
2011/0314902 A1 * 12/2011 Dantler ..... G08B 17/113 73/28.01
2012/0112920 A1 * 5/2012 Ramdeo ..... G08B 3/10 340/628
2013/0013227 A1 * 1/2013 Ajay ..... G01F 1/667 702/48
2013/0061659 A1 * 3/2013 Ajay ..... G08B 17/113 73/28.04
2013/0238138 A1 * 9/2013 Cole ..... G05B 15/02 700/275
2013/0263644 A1 * 10/2013 Dufour ..... G01N 33/0016 73/23.2
2014/0062706 A1 * 3/2014 Frazier ..... G08B 21/18 340/632
2015/0128722 A1 * 5/2015 Ajay ..... G01F 1/66 73/861.04
2015/0161865 A1 * 6/2015 Susel ..... G08B 29/16 340/628
2015/0235528 A1 * 8/2015 Ramer ..... G08B 5/36 340/517
2015/0308999 A1 * 10/2015 Villareal Guerra ..... G01N 33/0001 73/23.34
2016/0086468 A1 * 3/2016 Calvert ..... G08B 17/10 340/628
2016/0116389 A1 * 4/2016 Cooper ..... G08B 29/183 356/340
2016/0223437 A1 * 8/2016 Ajay ..... G08B 17/113
2017/0082586 A1 * 3/2017 Williamson ..... G01N 15/10
2017/0140619 A1 * 5/2017 Russo ..... G08B 21/14
2019/0285531 A1 * 9/2019 Cooper ..... G01N 15/0266
2019/0379030 A1 * 12/2019 Golubkov ..... H01M 50/502
2020/0109976 A1 * 4/2020 Ajay ..... G08B 17/10
2020/0271559 A1 * 8/2020 Cooper ..... G01N 15/0205
2020/0394886 A1 * 12/2020 Antar ..... G01N 33/0065
2021/0094686 A1 * 4/2021 Metzner ..... G08B 21/12
2021/0161075 A1 * 6/2021 Takayama ..... A01F 25/14
2021/0192913 A1 * 6/2021 Escofet Via ..... G08B 17/06

FOREIGN PATENT DOCUMENTS

CN 204029105 U 12/2014
CN 108131320 A 6/2018
CN 108355266 A 8/2018
CN 207945115 U 10/2018
EP 1006500 A2 6/2000
EP 2320397 B1 5/2012
EP 2320398 A1 11/2012
EP 2908301 A1 8/2015
JP H09147255 A 6/1997
WO 2010088049 A1 8/2010
WO 2019018590 A1 1/2019

* cited by examiner

POINT DETECTOR FOR FIRE ALARM SYSTEM

FOREIGN PRIORITY

This application claims priority to European Patent Application No. 19383182.3, filed Dec. 23, 2019, and all the benefits accruing therefrom under 35 U.S.C. § 119, the contents of which in its entirety are herein incorporated by reference.

TECHNICAL FIELD OF INVENTION

The present invention relates to a point detector for a fire alarm system and a method of operating a point detector for a fire alarm system.

BACKGROUND OF THE INVENTION

Known fire alarm systems of high-sensitivity detecting capabilities often require detecting devices which are large and cumbersome. Thus the detecting device is usually placed in a location far from the environment to be monitored. As such a network of holes and pipes may need to be installed in a building or structure such that air may be aspirated from the environment being monitored to the detecting device. Air is then aspirated from the target environment to the detecting device constantly such that the target environment may be monitored.

Whilst not only needing to constantly aspirate air from a target environment to the detecting device, a time of travel between a location to be monitored and the detecting device may be increased due to the distance between the detecting device and the target environment. In addition to the aforementioned disadvantages of known fire alarm systems, in certain circumstances a network of pipes and/or holes may not be able to be installed. This may include, for example, where logistically such pipes may not be able to be placed, or aesthetically such as in buildings of historical importance where such installations are restricted and/or prohibited.

Another known type of system uses point detectors located in areas where it is required to identify a possible fire. Such point detectors may be fire detectors or smoke detectors, for example. Point detectors are generally housed in a single enclosure, often made of plastic. The enclosure often contains all the operating features and/or components of the point detector including the detecting device, an internal power supply (either as the main power supply or as a back-up to a mains supply) and other components required to generate an alarm. As such the only external interaction a point detector has may be in the form of wired and/or wireless communication if the point detector is to form part of an array of detectors, or electrical communication which may power the point detector via an external power source (e.g. electrical mains). Thus point detectors may be easily and discretely placed in the environment they are intended to monitor, at detriment to their detecting capabilities given their generally small size.

SUMMARY OF THE INVENTION

Viewed from a first aspect the invention provides a point detector for a fire alarm system, the point detector comprising: a fan configured to aspirate air from a surrounding environment; and an inlet in flow communication with the fan; wherein the inlet is configured to split the incoming flow into multiple streams; and wherein each stream of the multiple streams is configured to be in flow communication with a respective sensing device.

The proposed device thus modifies a typical smoke or fire point detection device via the addition of a fan for aspiration of air as well as multiple sensing devices with a corresponding division of the incoming flow. As will be appreciated, providing the point detector with a fan configured to aspirate air from a surrounding environment will lead to active detection of substances and/or conditions which may indicate a fire. These may include, for example, smoke, carbon monoxide, and heat. Aspirating the air to the point detector reduces the time taken for a sample of air to reach a sensing device and as such the time taken to raise an alarm or detect a relevant substance and/or condition is reduced. It will readily be understood that reducing the time between the start of an event, for example that relating to a fire, and the time of detection will prompt users and/or systems to act appropriately. Being notified of a fire or a fire-related event and the like during its incipient phase may reduce any damage or injury resulting from such an event, and/or increase the likelihood that a more serious event is negated. The proposed point detector is advantageously capable of being placed in the environment to be monitored, with little disturbance to said environment, with the ability to provide high-sensitivity fire detecting capabilities, and which may provide rapid response times during the incipient stage of a fire.

Each of the multiple streams may be configured to provide the incoming flow to a single respective sensing device. It will be understood that this may entail the stream being connected to an aperture or port of the respective sensing device, the sensing device being disposed along a length of the stream, and/or the stream being configured however necessary such that the sensing device that receives and/or is in flow communication with a stream of the split incoming flow is able to function correctly. Each of the multiple streams may be an independent flow path from each of the other streams. As such the multiple streams may also be considered as multiple independent flow paths, wherein each independent flow path is configured to be in flow communication with a single sensing device respectively.

Splitting the incoming flow into multiple independent streams allows for multiple sensing devices to be housed within the point detector, each of the sensing devices being able to be operated simultaneously. As such the point detector may be able to house, for example, two or more of a smoke detector, a carbon monoxide detector, and a heat detector. The use of multiple streams, each independent of one another, allows for simultaneous sensing and detecting of the aspirated air such that the time taken to identify various substances and/or conditions which may indicate a fire may be reduced. Moreover, the signals from multiple sensing devices may be used in conjunction such that various alarms may be generated by the point detector accordingly.

The point detector may comprise an early-warning smoke detector for early detection of smoke in the surrounding environment. The early-warning smoke detector may be in a separate flow circuit to the fan, inlet and multiple streams. It may be located in an outer part of the point detector, with the sensing devices being in an inner part of the point detector. The early-warning smoke detector may be housed on an external surface of the point detector, such as on an outer part of a housing of the point detector. The early-warning smoke detector may be a passive smoke detector, i.e. not comprising a fan. Similarly the early-warning smoke detector could be in flow communication with the fan or its own fan, the fan in flow communication with the early-warning smoke detector operating at a low fan speed; i.e. the fan may be configured to have a pumping/suction rate lower than 0.5 litres per minute. The early-warning smoke detector may detect a trace amount of smoke in the surrounding environment before any sensing devices disposed in the multiple streams. As such the early-warning smoke detector may be considered to be an early-warning smoke detector in the sense that it provides an earlier alert of a possible fire than the other sensing devices, which may not be able to detect a risk until a later time, after some movement of air to the sensing devices.

The early-warning smoke detector may be a high-sensitivity smoke detector. That is, the early-warning smoke detector may be configured to detect smoke at a lower threshold than conventional smoke detectors or any other sensing device comprised in the point detector that functions as a smoke detector. In some examples, the early-warning smoke detector may have a sensitivity to smoke of an opacity of less than 1%/m, less than 0.9%/m, less than 0.8%/m, less than 0.7%/m, less than 0.6%/m, or less than 0.5%/m, as appropriate.

It is also to be appreciated that conventional smoke detectors or any other sensing device that functions as a smoke detector comprised in the point detector may have a sensitivity that varies depending on the size of the particle(s) it is configured to detect. As such the sensitivity of the early-warning smoke detector may also vary depending on the size of the particle(s) such that it will detect smoke of varying particle size at a lower respective threshold than conventional smoke detectors or any other sensing device comprised in the point detector that functions as a smoke detector.

The point detector may be configured to aspirate air from the surrounding environment in response to a detection of smoke by the early-warning smoke detector. That is, in a first mode of operation, which may be termed a normal or stand-by mode, the fan in flow communication with the inlet may be off and/or inactive such that no air is aspirated, whereas in a second mode of operation, which may be termed an activated or detection mode, the fan may be active. The second mode may be triggered in reaction to the early-warning smoke detector detecting smoke, with the point detector then powering the fan such that air is aspirated from the surrounding environment.

The point detector may be configured to vary a speed of the fan when the early-warning smoke detector detects smoke. The variation of the fan speed may be an increase and/or a decrease in the speed of the fan. For example, the fan may be configured to be in flow communication not only with the inlet, but also with the early-warning smoke detector. The fan may operate in a low-power mode when no smoke is detected by the early-warning smoke detector. However, upon detecting smoke using the early-warning smoke detector, the point detector may increase a speed of the fan such that a larger volume of air is aspirated to the multiple streams and thus to the multiple sensing devices. As such the point detector may be configured to increase a speed of the fan in response to the early-warning smoke detector detecting smoke. In one example, the first mode discussed above may be modified so that it involves a relatively low fan speed, rather than an inactive fan, with the second mode then involving a relatively high fan speed, with the speed increasing compared to the first mode.

The point detector may comprise a controller configured to vary the speed of the fan in response to the early-warning smoke detector detecting smoke.

By only aspirating air in response to the early-warning smoke detector detecting smoke, or by operating the fan in a low-power mode when smoke is not detected by the early-warning smoke detector, the energy required to operate the point detector may be reduced and/or conserved. This may be particularly advantageous if the point detector is battery powered, as the lifetime of the battery powering the point detector may be increased. Similarly, noise which may be created by the may be reduced when there is indicative reason as to why the air may need to be analysed by the multiple sensing devices.

The point detector may comprise various sensing devices, each sensing device in flow communication with a respective stream. The sensing devices may comprise two or more of a smoke detector, a heat detector, and a carbon monoxide detector. Each of the sensing devices, which may comprise all three of the smoke detector, the heat detector, and the carbon monoxide detector, may therefore be in flow communication with a first stream, a second stream and a third stream respectively where three sensing devices are used. That is, each sensing device may be paired to a single stream independent of the streams connected to the other sensing devices comprised in the point detector.

At least two of the smoke detector, the heat detector, and the carbon monoxide detector may be operated simultaneously by the point detector. As each sensing device is provided with its own stream, flow to each sensing device is concurrent and thus each sensing device may be operated independently of the other. As such smoke detection, heat detection and carbon monoxide detection may occur instantly from when the fan aspirates air to the inlet and thus the time to detection may be reduced.

A housing may be provided to hold the various features of the point detector, optionally to enclose all of the features thereof. Thus, there may be a wall surrounding the various features discussed above, with the point detector hence being a single self-contained device with connections to external systems that are primarily (or only) for power and/or data transmission. The housing may thus enclose the fan and sensing devices, and the early-warning smoke detector, may be mounted on or held within the housing. The point detector may include a power source such as a battery, which would also be held by the housing and preferably fully contained therein.

The point detector may be configured to generate an alarm when at least two of smoke, heat and carbon monoxide are detected by the smoke detector, the heat detector, and the carbon monoxide detector respectively. As such a user or operating system or an external monitoring system in communication with the point detector may only be notified of an alarm event when, say, heat and smoke are detected simultaneously. This may aid the point detector in reducing a number of false-positive alarms which may otherwise be generated during the detection of heat or smoke alone. Additionally or alternatively, requiring the generation of an alarm when at least two of smoke, heat and carbon monoxide are detected may enable the point detector to distinguish between various sources which may be responsible for the substances and/or conditions causing the alarm.

The point detector may comprise a processor. The processor may be configured to operate the controller. The processor may be configured to receive signals from the sensing devices when they sense and/or detect a substance and/or condition they are configured to sense and/or detect. The processor may be configured to generate the alarm upon receiving the signals from the sensing devices. The processor may be configured to monitor a battery life of the point detector if it is a battery powered device. The processor may be configured to emit a signal to an external monitoring system, notifying it of an alarm event. As such the point detector may comprise communication means, such as a wired electrical communication or a wireless communication device configured to receive and/or emit Bluetooth, infrared, of Wi-Fi signals, or any other suitable method of external communication, as appropriate.

Viewed from a second aspect the invention provides a method of operating a point detector for a fire alarm system, the method comprising: aspirating air from a surrounding environment using a fan; splitting an incoming flow at an inlet into multiple streams, wherein the inlet is in flow communication with the fan; and determining, using a sensing device in flow communication with one of the multiple streams, a property of the flow.

The proposed method thus modifies the method of operation of a typical smoke or fire point detection device by using a fan for aspiration of air as well as multiple sensing devices with a corresponding division of the incoming flow. As will be appreciated, aspirating air from a surrounding environment will lead to active detection of substances and/or conditions which may indicate a fire. These may include, for example, smoke, carbon monoxide, and heat. Aspirating the air to the point detector reduces the time taken for a sample of air to reach a sensing device and as such the time taken to raise an alarm or detect a relevant substance and/or condition is reduced. It will readily be understood that reducing the time between the start of an event, for example that relating to a fire, and the time of detection will prompt users and/or systems to act appropriately. Being notified of a fire or a fire-related event and the like during its incipient phase may reduce any damage or injury resulting from such an event, and/or increase the likelihood that a more serious event is negated.

Each of the multiple streams may be configured to provide the incoming flow to a single respective sensing device. It will be understood that this may entail the stream being connected to an aperture or port of the respective sensing device, the sensing device being disposed along a length of the stream, and/or the stream being configured however necessary such that the sensing device that receives and/or is in flow communication with a stream of the split incoming flow is able to function correctly. Each of the multiple streams may be an independent flow path from each of the other streams. As such the multiple streams may also be considered as multiple independent flow paths, wherein each independent flow path is configured to be in flow communication with a single sensing device respectively.

Splitting the incoming flow into multiple independent streams allows for multiple sensing devices to be operated simultaneously within the point detector. As such the point detector may be able to house, for example, two or more of a smoke detector, a carbon monoxide detector, and a heat detector. The use of multiple streams, each independent of one another, allows for simultaneous sensing and detecting of the aspirated air such that the time taken to identify various substances and/or conditions which may indicate a fire may be reduced. Moreover, the signals from multiple sensing devices may be used in conjunction such that various alarms may be generated by the point detector accordingly.

The method may comprise the step of detecting smoke using an early-warning smoke detector. The early-warning smoke detector may be a high sensitivity smoke detector. That is, the early-warning smoke detector may be configured to detect smoke at a lower threshold than conventional smoke detectors or any other sensing device comprised in the point detector that functions as a smoke detector. In some examples, the early-warning smoke detector may have a sensitivity to smoke of an opacity of less than 1%/m, less than 0.9%/m, less than 0.8%/m, less than 0.7%/m, less than 0.6%/m, or less than 0.5%/m, as appropriate.

It is also to be appreciated that conventional smoke detectors or any other sensing device that functions as a smoke detector comprised in the point detector may have a sensitivity that varies depending on the size of the particle(s) it is configured to detect. As such the sensitivity of the early-warning smoke detector may also vary depending on the size of the particle(s) such that it will detect smoke of varying particle size at a lower respective threshold than conventional smoke detectors or any other sensing device comprised in the point detector that functions as a smoke detector.

Thus the method may perform the step of detecting smoke using an early-warning smoke detector before the step of determining, using a sensing device in flow communication with one of the multiple streams, a property of the flow.

The method may comprise the step of aspirating air from the surrounding environment using a fan in response to the early-warning smoke detector detecting smoke. As such the method may also comprise the step of, in response to the early-warning smoke detector detecting smoke, supplying power to the fan. That is, the method may comprise operating the fan in a first mode of operation, which may be termed a normal or stand-by mode. Upon detecting smoke using the early-warning smoke detector, the method may, in response, comprise operating the fan in a second mode of operation, which may be termed an activated or detection mode, wherein the fan is active.

The method may comprise the step of varying a speed of the fan in response to the early-warning smoke detector detecting smoke. The variation of the fan speed may be an increase and/or a decrease in the speed of the fan. For example, the fan may be configured to be in flow communication with the inlet, but also with the early-warning smoke detector. The method may therefore comprise the step of operating the fan in a first mode of operation. The first mode may be termed a normal or stand-by mode. The fan may operate in the first mode when no smoke is detected by the early-warning smoke detector. However, upon detecting smoke using the early-warning smoke detector, the point detector may increase a speed of the fan. Increasing a speed of the fan may result in a larger volume of air being aspirated to the multiple streams and thus to the multiple sensing devices. As such the method may comprise the step of increasing a speed of the fan in response to the early-warning smoke detector detecting smoke. This mode of operation may be termed the second mode of operation. The second mode may be considered an activated or detection mode.

By only aspirating air in response to the early-warning smoke detector detecting smoke, or by operating the fan in a low-power mode when smoke is not detected by the early-warning smoke detector, the energy required to operate the point detector may be reduced and/or conserved. This may be particularly advantageous if the point detector is battery powered, as the lifetime of the battery powering the point detector may be increased. Similarly, noise which may be created by the may be reduced when there is indicative reason as to why the air may need to be analysed by the multiple sensing devices.

The method may also comprise the step of controlling, using a controller, the speed of the fan in response to the early-warning smoke detector detecting smoke.

The point detector may comprise various sensing devices, each sensing device in flow communication with a respective stream. The sensing devices may comprise at least two of a smoke detector, a heat detector, and a carbon monoxide detector. Each of the smoke detector, the heat detector, and the carbon monoxide detector may therefore be in flow communication with a first stream, a second stream and a third stream respectively. That is, each sensing device may be paired to a single stream independent of the streams connected to the other sensing devices comprised in the point detector. As such the method may comprise the step of using a smoke detector for sensing smoke in a first stream of the multiple streams; using a heat detector for sensing heat in a second stream of the multiple streams; and using a carbon monoxide detector for sensing carbon monoxide in a third stream of the multiple streams; wherein each of the smoke detector, the heat detector, and the carbon monoxide detector is the respective sensing device in each of the multiple streams.

The method may comprise performing the steps of using at least two of the smoke detector, using the heat detector, and using the carbon monoxide detector simultaneously. As each sensing device is provided with its own stream, flow to each sensing device is concurrent and thus each sensing device may be operated independently of the other. As such smoke detection, heat detection and carbon monoxide detection may occur instantly from when the fan aspirates air to the inlet and thus the time to detection may be reduced.

The method may comprise the step of generating an alarm when at least two of smoke, heat and carbon monoxide are detected by the smoke detector, the heat detector, and the carbon monoxide detector respectively. As such a user or operating system or an external monitoring system in communication with the point detector may only be notified of an alarm event when, say, heat and smoke are detected simultaneously. This may aid the point detector in reducing a number of false-positive alarms which may otherwise be generated during the detection of heat or smoke alone. Additionally or alternatively, requiring the generation of an alarm when at least two of smoke, heat and carbon monoxide are detected may enable the point detector to distinguish between various sources which may be responsible for the substances and/or conditions causing the alarm.

The method may be executed by a processor of the point detector. As such the point detector may comprise a processor configured to operate the point detector. The method may comprise the step of receiving, using the processor, signals from the sensing devices when they sense and/or detect a substance and/or condition they are configured to sense and/or detect. The method may require the step of generating, using the processor, the alarm upon receiving the signals from the sensing devices. The method may comprise the step of monitoring, using the processor, a battery life of the point detector if it is a battery powered device. The method may comprise the step of emitting, using the processor, a signal to an external monitoring system, notifying it of an alarm event. As such the point detector may comprise communication means, such as a wired electrical communication or a wireless communication device configured to receive and/or emit Bluetooth, infrared, of Wi-Fi signals, or any other suitable method of external communication, as appropriate.

The method of the second aspect may have one or more steps corresponding to the use of features of the first aspect. Thus the above description of the apparatus of the first aspect, including but not limited to all technical advantages and alternative embodiments, may be equally applicable to the method of the second aspect.

The method may performed by the point detector of the first aspect. As such the method may be a method of operating the point detector of the first aspect.

BRIEF DESCRIPTION OF THE DRAWINGS

Certain example embodiments of the invention will now be described by way of example only and with reference to the accompanying drawings in which.

DETAILED DESCRIPTION OF THE INVENTION

Figure 1:
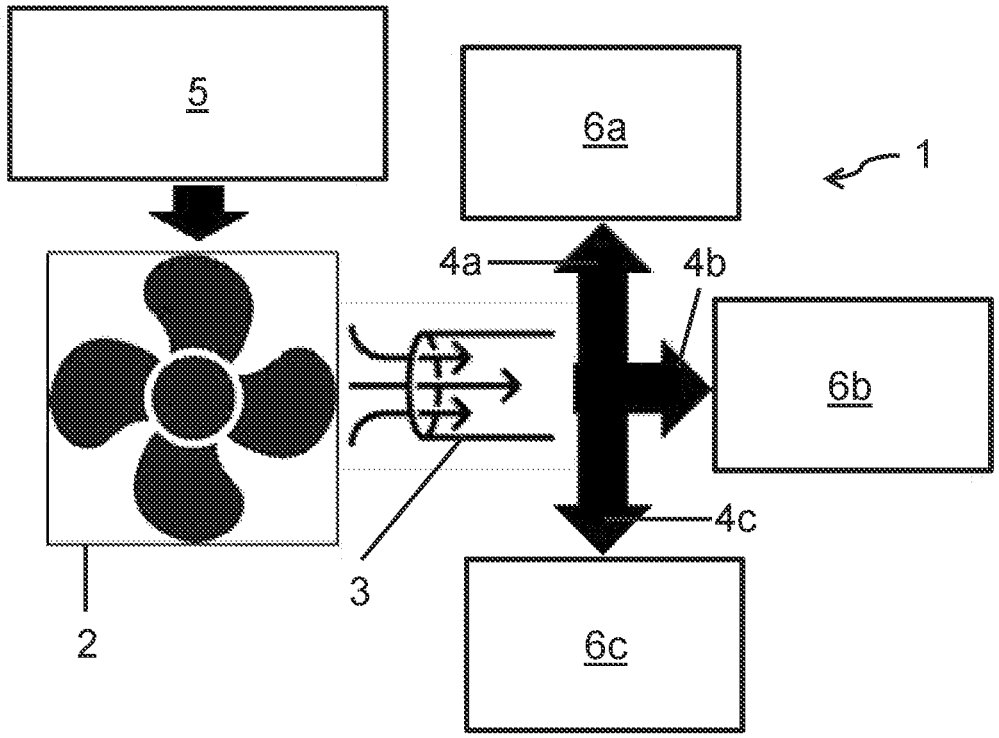
FIG. 1 shows a schematic diagram of a point detector using a fan.
Figure 2:
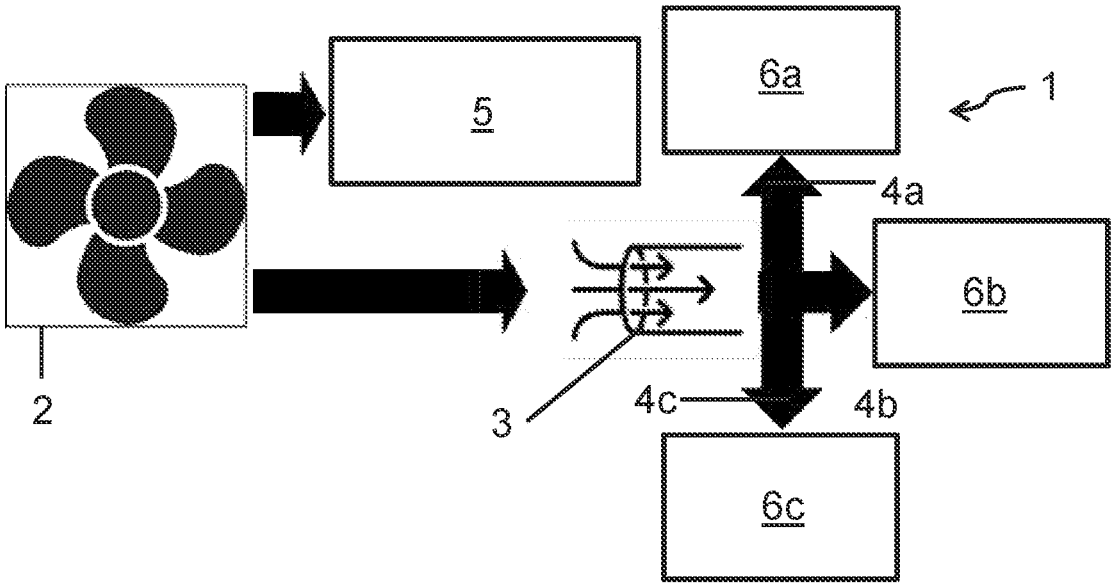
FIG. 2 shows a schematic diagram of another point detector using a fan.

With reference to FIG. 1 and FIG. 2, a point detector 1 comprises a fan 2, an inlet 3, multiple streams and/or multiple flow paths 4, an early-warning smoke detector 5 and sensing devices 6.

The fan 2 is configured to aspirate air from a surrounding environment of the point detector 1. As such, a sample of air may be actively drawn from the surrounding environment to the point detector 1 using the fan 2. The fan may be any conventional fan, pump or blower as are readily known and understood in the art.

The aspirated air from the fan 2 is directed to the inlet 3 via a flow path. As such the fan 2 is in flow communication with the inlet 3. The inlet 3 splits the incoming flow into multiple streams 4. To split the incoming stream the inlet 3 may be a four-way valve, the inlet 3 comprising one inlet port and three outlet ports. Whilst three streams 4 are shown in the Figures, the inlet 3 may split the incoming flow into an appropriate number of streams 4 as required.

In flow communication exclusively with a stream 4 of the multiple streams 4 is the sensing device 6. The sensing device 6 is for determining and/or detecting a condition and/or substance indicative of a fire. Sensing devices 6 which may be used for determining and/or detecting a condition and/or substance indicative of a fire are well-known in the art and therefore will not be described in any detail herein.

The point detector 1 as shown in the Figures may comprise an early-warning smoke detector 5. The early-warning smoke detector 5 is preferably more sensitive to smoke than any other sensing device 6 in the point detector 1 and thus under passive detecting conditions, wherein air flows to the point detector 1 via stochastic processes rather than being aspirated, the early-warning smoke detector 5 may determine a presence of smoke in the surrounding environment before any other sensing devices 6 in the point detector 1. As such the early-warning smoke detector 5 need not be in flow communication with the fan 2, as shown in FIG. 1, but it may be in flow communication with the fan 2 nevertheless, as shown in FIG. 2.

The point detector 1 may be configured such that air is only aspirated via the fan 2 once smoke has been detected, or its presence determined, using the early-warning smoke detector 5. Once the early-warning smoke detector 5 detects smoke, the point detector 2 may therefore be configured to increase a speed of the fan, such that air is aspirated to the inlet 3 and thus actively passed to the sensing devices 6. The speed and/or operation of the fan 2 may be controlled via a controller (not shown).

The speed of the fan 2 may either be increased from a zero-value (i.e. it is switched on), and/or may be increased such that the fan 2 transitions from a low-power mode to a high-power mode. Whilst the fan may operate in a low-power mode at all times in the point detector 1 shown in both FIG. 1 and FIG. 2, it will be appreciated that operating the fan 2 in a low-power mode in the point detector of FIG. 2 will provide active detecting conditions for the early-warning smoke detector 5.

The aspirated air is provided to the inlet 3, which splits the incoming flow into multiple streams 4. In each stream 4 is a respective sensing device 6. As such the sensing device 6 may be a smoke detector 6*a* in flow communication with a first stream 4*a*, a heat detector 6*b* in flow communication with a second stream 4*b*, or a carbon monoxide detector 6*c* in communication with a third stream 4*c*. Whilst the point detector 1 shown in the Figures comprises three sensing devices 6, it is to be appreciated that the point detector 1 may only require at least two of the sensing devices 6 as appropriate.

The point detector 1 may generate an alarm when at least two of the smoke detector 6*a*, the heat detector 6*b*, and the carbon monoxide detector 6*c* detects smoke, heat, and carbon monoxide, respectively. The combinations of signals from the sensing devices 6*a*, 6*b*, 6*c* may be used by the point detector 1 to differentiate and/or distinguish between different fire sources and/or conditions and thus an appropriate alarm may be generated.

The point detector 1 may be a standalone device comprising a power source (not shown), such as a battery. Similarly it may be connected to an external power source (not shown).

The point detector 1 may comprise a processor (not shown). The processor may be configured to operate the controller for the fan 2. The processor may be configured to receive signals from the sensing devices 6 when they sense and/or detect a substance and/or condition they are configured to sense and/or detect. The processor may be configured to generate the alarm upon receiving the signals from the sensing devices 6. The processor may be configured to monitor a battery life of the point detector if it is a battery powered device. The processor may be configured to emit a signal to an external monitoring system, notifying it of an alarm event. As such the point detector may comprise communication means (not shown), such as a wired electrical communication or a wireless communication device configured to receive and/or emit Bluetooth, infrared, of Wi-Fi signals, or any other suitable method of external communication, as appropriate.

What is claimed is:

1. A point detector (1) for a fire alarm system, the point detector (1) comprising:

a fan (2) configured to aspirate air from a surrounding environment;

an inlet (3) in flow communication with the fan (2); and a smoke detector (6*a*), a heat detector (6*b*) and a carbon monoxide detector (6*c*);

wherein the inlet (3) is configured to split the incoming flow into multiple streams (4);

wherein the smoke detector (6*a*) is for sensing smoke in a first stream (4*a*) of the multiple streams (4);

wherein the heat detector (6*b*) is for sensing heat in a second stream (4*b*) of the multiple streams (4);

wherein the carbon monoxide detector (6*c*) is for sensing carbon monoxide in a third stream (4*c*) of the multiple streams (4); and wherein the point detector (1) is configured to generate an alarm when at least two of smoke, heat, and carbon monoxide are detected by the smoke detector (6*a*), the heat detector (6*b*), and the carbon monoxide detector (6*c*), respectively.

2. A point detector (1) as claimed in claim 1, comprising an early-warning smoke detector (5).

3. A point detector (1) as claimed in claim 2, wherein the early-warning smoke detector (5) is configured to be more sensitive to smoke than the smoke detector (6*a*).

4. A point detector (1) as claimed in claim 2, wherein the point detector (1) is configured to use the fan (2) to aspirate air from a surrounding environment in response to the early-warning smoke detector (5) detecting smoke.

5. A point detector (1) as claimed in claim 2, wherein the point detector (1) is configured to increase the speed of the fan (2) in response to the early-warning smoke detector (5) detecting smoke.

6. A point detector (1) as claimed in claim 2, comprising a controller configured to control the speed of the fan (2) in response to the early-warning smoke detector (5) detecting smoke.

7. A point detector (1) as claimed in claim 1, wherein the point detector (1) is configured to simultaneously operate at least two of the smoke detector (6*a*), the heat detector (6*b*), and the carbon monoxide detector (6*c*).

8. A point detector (1) as claimed in claim 1, comprising a processor;

wherein the processor is configured to control the operational function of the point detector (1).

9. A method of operating a point detector (1) including a fan (2) configured to aspirate air from a surrounding environment; an inlet (3) in flow communication with the fan (2); and a smoke detector (6*a*), a heat detector (6*b*) and a carbon monoxide detector (6*c*), the method comprising:

aspirating air from a surrounding environment using the fan (2);

splitting an incoming flow at the inlet (3) into multiple streams (4), wherein the inlet (3) is in flow communication with the fan (2);

using the smoke detector (6*a*) for sensing smoke in a first stream (4*a*) of the multiple streams (4);

using the heat detector (6*b*) for sensing heat in a second stream (4*b*) of the multiple streams (4);

using the carbon monoxide detector (6*c*) for sensing carbon monoxide in a third stream (4*c*) of the multiple streams (4);

determining, using each of the smoke detector (6*a*), the heat detector (6*b*), and the carbon monoxide detector (6*c*) in flow communication with the first stream (4*a*), the second stream (4*b*) and the third stream (4*c*) respectively, a property of the flow; and generating an alarm when at least two of smoke, heat, and carbon monoxide are detected by the smoke detector (6*a*), the heat detector (6*b*), and the carbon monoxide detector (6*c*) respectively.

10. A method as claimed in claim 9, comprising:

detecting smoke using an early-warning smoke detector (5).

11. A method as claimed in claim 10, comprising:

aspirating air from the surrounding environment using the fan (2) in response to the early-warning smoke detector (5) detecting smoke.

12. A method as claimed in claim 10, wherein the early-warning smoke detector (5) is configured to be more sensitive to smoke than the smoke detector (6*a*).

13. A method as claimed in claim 11, comprising:

increasing a speed of the fan (2) in response to the early-warning smoke detector (5) detecting smoke.

* * * * *